United States Patent [19]

Hoff et al.

[11] 4,421,453

[45] Dec. 20, 1983

[54] CENTRIFUGAL OIL PUMP

[75] Inventors: Herbert L. Hoff, Holmen; Daniel C. Leaver, La Crosse, both of Wis.

[73] Assignee: The Trane Company, La Crosse, Wis.

[21] Appl. No.: 349,798

[22] Filed: Feb. 18, 1982

[51] Int. Cl.[3] ..... F04B 39/02

[52] U.S. Cl. ..... 415/88; 417/368; 417/372; 184/6.16; 184/31

[58] Field of Search ..... 415/83, 88, 143; 416/179; 417/368, 369, 372, 902; 184/6.16, 6.18, 31; 366/264, 265

[56] References Cited

U.S. PATENT DOCUMENTS

| | | | |
|---|---|---|---|
| 2,267,341 | 12/1941 | Schmidt | 366/264 |
| 2,898,072 | 8/1959 | Buschmann | 184/6.16 X |
| 3,078,958 | 2/1963 | Hoenick | 184/6.18 X |
| 3,396,903 | 8/1968 | Oya . | |
| 3,563,677 | 2/1971 | Retan | 417/415 |
| 3,610,773 | 10/1971 | Polomsky | 415/88 X |
| 3,610,784 | 10/1971 | Rundell | 417/415 |
| 3,876,339 | 4/1975 | Gannaway | 417/902 X |
| 3,926,281 | 12/1975 | Hannibal | 417/372 X |
| 3,934,967 | 1/1976 | Gannaway | 417/271 |
| 4,131,396 | 12/1978 | Privon et al. | 417/902 X |

*Primary Examiner*—Stephen Marcus
*Assistant Examiner*—Joseph M. Pitko
*Attorney, Agent, or Firm*—Carl M. Lewis; Ronald M. Anderson; Raymond W. Campbell

[57] ABSTRACT

A centrifugal oil pump for a compressor having improved head and flow performance in which a plurality of tunnels extend radially outward and angularly upward from the face of the impeller and convey oil to the perimeter of the drive shaft during operation. The oil is collected in a chamber of a housing around the bottom of the crankshaft, flows through a channel of an end plate and is transmitted upwardly in a bore of the crankshaft. Entrained gases are vented from each inlet hole to a common annular ring, and through a vent from the annular ring upwardly in the crankshaft.

12 Claims, 9 Drawing Figures

FIG. 1
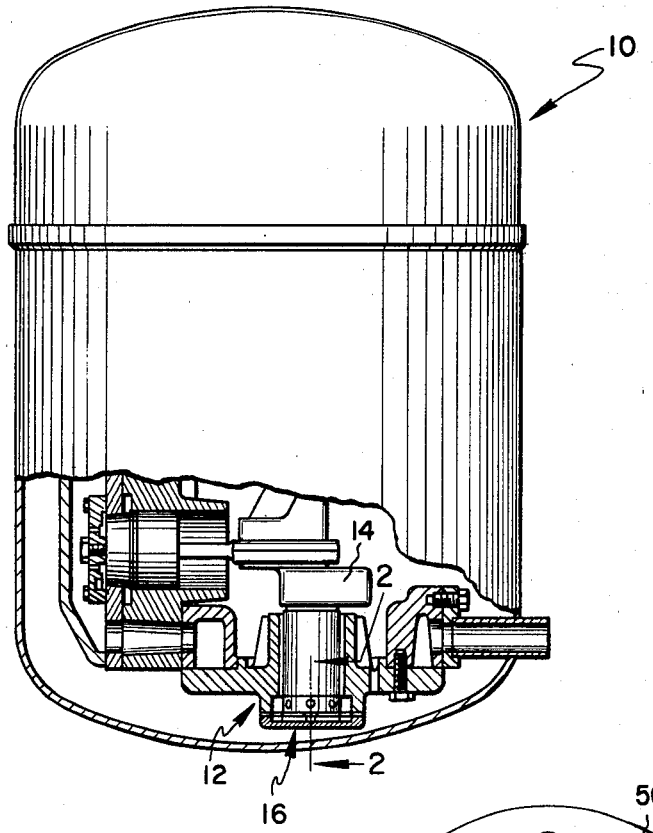
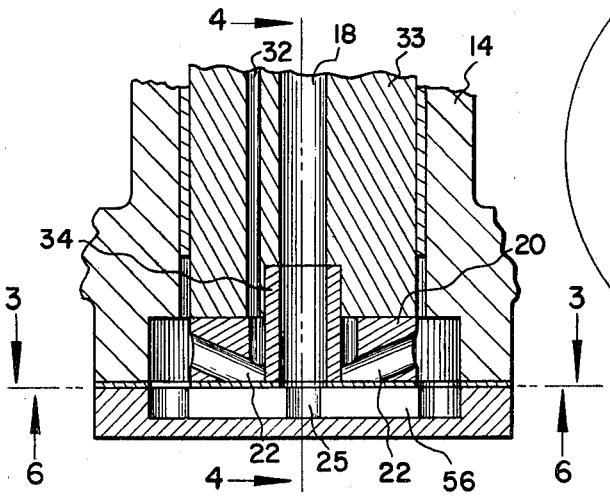
FIG. 2
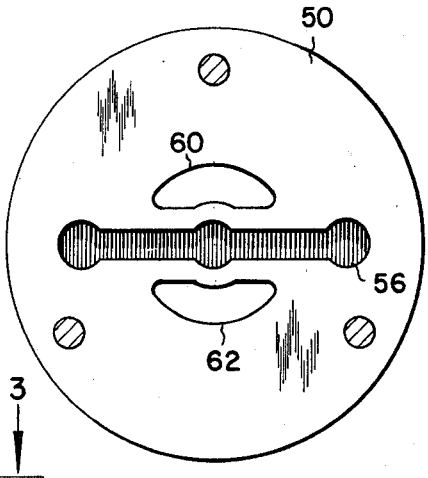
FIG. 3

CENTRIFUGAL OIL PUMP

DESCRIPTION

1. Technical Field

The present invention pertains generally to the field of centrifugal fluid pumps and specifically to the field of centrifugal oil pumps for reciprocating compressors.

2. Background Art

Centrifugal pumps disposed on the bottoms of vertically oriented crankshafts are used for circulating oil in reciprocating compressors to lubricate bearings and other moving parts. The oil is drawn from a sump by an impeller which in many types of centrifugal pumps is formed in the end of the crankshaft, and the oil is caused to rise in a longitudinal bore of the crankshaft to reach the bearing surfaces. The performance of such a centrifugal pump is related to the speed of the crankshaft, with increased performance resulting from faster crankshaft speeds.

Various types of centrifugal pumps have been used in the past, including cone-shaped pumps which feed the oil upwardly to the bore in the crankshaft and cylindrical pumps having annular inlet grooves in a bottom end surface communicating with radial holes extending horizontally to the perimeter of the pump. Oil in the annular groove is thrown outwardly through the radial holes by centrifugal force, and is collected in chambers of a housing surrounding the bottom of the crankshaft. From the chamber the oil flows into a channel of an end plate and is conveyed to the bore of the crankshaft, through which it is transmitted to the bearings for lubricating the compressor. For the most part, these types of pumps perform adequately in relatively high-speed compressors; however, since the performance of the pump is related to the speed of the crankshaft, the performances of prior designs for centrifugal pumps have proved to be inadequate for slower speed compressors. For adequate lubrication of the upper bearings in slow speed compressors, the pumps must perform at, or near, peak efficiency, which is not always attainable in an operating system.

To increase the pumping capabilities of centrifugal pumps, various types of vanes have been used in the inlet region of the pump. The vanes act as scoops to capture oil from the sump. Although the addition of vanes increases the pump performance, various disadvantages are also associated with the use of vanes. Permanent attachment of the vanes in the inlet region is crucial in that detachment of a vane can result in substantial damage to the compressor. Further, the vanes are positioned angularly in the pump, to scoop the oil from the sump efficiently. If the compressor is operated in a reverse direction to the intended direction the pump will not perform, and severe compressor damage can occur quickly. Thus, an inadvertent installation error can result in significant and costly compressor damage.

SUMMARY OF THE INVENTION

It is therefore one of the principal objects of the present invention to provide a centrifugal oil pump having improved head and flow performance, for providing adequate lubrication of upper bearings in slow speed compressors.

Another object of the present invention is to provide a centrifugal oil pump having vane-like bodies integral with the rotating pump impeller, thereby eliminating the potential for vane detachment and compressor damage resulting therefrom.

A further object of the present invention is to provide a centrifugal oil pump which performs equally well in either direction of crankshaft rotation, thereby assuring lubrication of the compressor bearings even in the face of installation error, and which vents entrained gases adequately to prevent vapor lock in the pump.

These and other objects are achieved in the present invention by providing a plurality of tunnels extending radially outward and angularly upward from the bottom surface of a pump impeller body disposed on the end of the compressor crankshaft. The regions of the body which remain between the tunnels function as vanes to aid in scooping oil from the sump. The vanes are symmetrical, permitting the pump to be operated in either direction without a loss in performance. The oil gathered and transmitted outwardly by the tunnels is collected in chambers in a housing surrounding the impeller, and the oil is transmitted through a seal to a channel in the pump end plate for transmittal upwardly in an axial bore of the crankshaft in conventional fashion. Each of the tunnels communicates with an annular vent passage through vent conduits in the impeller, and the passage is vented upwardly in the crankshaft to remove entrained gases from the pump, thereby preventing cavitation or vapor lock.

Further objects and advantages of the present invention will become apparent from the detailed description and the accompanying drawings.

BRIEF DESCRIPTION OF THE DRAWINGS

FIG. 1 is an elevational view, partially broken away and in partial cross-section, of a reciprocating compressor having a centrifugal oil pump embodying the present invention.

FIG. 2 is a cross-sectional view of the oil pump shown in FIG. 1, taken on line 2—2 of the latter Figure.

FIG. 3 is a horizontal cross-sectional view of the pump taken on line 3—3 of FIG. 2.

DETAILED DESCRIPTION OF THE PREFERRED EMBODIMENT

Figure 4:
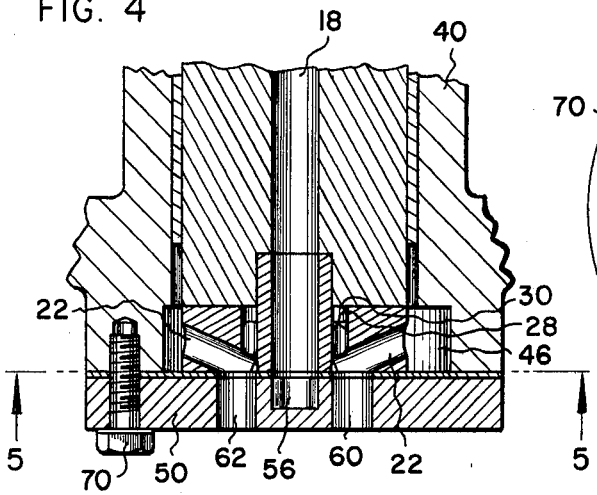
FIG. 4 is a vertical cross-sectional view of the centrifugal oil pump taken on line 4—4 of FIG. 2.

Referring now more specifically to the drawings, and to FIG. 1 in particular, numeral 10 designates a reciprocating compressor having a centrifugal oil pump 12 embodying the present invention disposed on the lower end of a vertically oriented crankshaft 14. The pump operates in a sump 16 which contains oil, and the oil moved by pump 12 rises in an axial bore 18 in the crankshaft to the lubrication sites of the compressor.

Pump 12 includes an oil impeller 20 which is driven by the crankshaft and captures oil in the sump, throwing the oil outwardly by centrifugal force. A plurality of tunnels 22 extend angularly upward and radially outward from the bottom surface 24 of the impeller, the tunnels having bottom inlet openings 22*a* in the substantially planar surface 24, a distance $R_1$ from the pump center line, and upper outlet openings 22*b* along the perimeter of the impeller a distance $R_2$ from the center line. Disposing the tunnels at angles of about twenty degrees (20°) from the horizontal has been found to provide the necessary differential in inlet and outlet planes for given impeller diameters, and maximizing the difference $(R_2-R_1)$ maximizes the pump output for given impeller diameters. The inlet openings are equally spaced about a central opening 25 in the impeller, which opening is aligned with bore 18. Substantially triangular-shaped regions 26 remain between adjacent tunnels 22, and the regions act as vanes to scoop the oil from sump 16. Since the vanes are integral regions of the impeller, the vanes cannot become unattached accidentally and cause compressor damage. The symmetrical shapes of the tunnels and vanes permit the impeller to capture oil and to impel it outwardly through the tunnels for either direction of crankshaft rotation.

To prevent cavitation or vapor lock, the entrained gases must be vented, and venting is most effective if done at, or near, the pump inlet. Hence, a vent conduit 28 is provided for each of the tunnels 22 at the inlet opening 22*a* thereof, and the conduits communicate with a common annular vent passage 30 in the impeller which has a vent outlet 32 therefrom. Different manufacturing approaches can be used for forming the vent system; however, one approach is to produce the impeller as a two-piece assembly. The lower piece is that previously described and indicated by the numeral 20, containing the tunnels and vent conduits and an annular groove in the top thereof for forming the vent passage. The lower piece can be made of metal such as die cast aluminum, of molded plastic or of other suitable materials. The second or upper piece includes a sleeve 33 for receiving a reduced end section 34 of the lower piece. The upper piece can be formed in the end of the crankshaft rather than as a separate piece attached to the crankshaft, and the upper piece contains the vent outlet 32. The two impeller pieces can be pressed or bonded together after machining or otherwise forming the tunnels, conduits, passages and the like, with the upper surface of the lower piece mating with the end of the upper piece. The annular vent passage is thus formed by the annular groove in the top of the lower piece radially outward from the reduced end section being covered by the bottom surface of the upper piece. The vent outlet in the upper piece is located therein to communicate with the annular vent passage when the two pieces are brought together during assembly.

A housing 40 surrounds the impeller and includes chambers 42, 44, and 46 for receiving the oil thrown outwardly from tunnels 22. The oil can flow from chamber to chamber between impeller 20 and housing 40. A seal 48 is disposed between the housing and an end plate 50 of the pump, and holes 52 and 54 in the seal permit the fluid to flow from the chambers to a channel 56 in the end plate. The seal otherwise covers the end of the impeller and housing so that oil in the chambers can flow only into the channel. Seal 48 also contains a central opening 58 aligned with central opening 25 and axial bore 18, permitting oil entering channel 56 from the housing chambers to flow into and upwardly in the bore. Oil entry openings 60 and 62 in end plate 50 are aligned with oil entry openings 64 and 66 in the seal, thereby exposing tunnel inlet openings 22*a* to the oil in the sump when the impeller is immersed in the oil in the sump.

Figure 7:
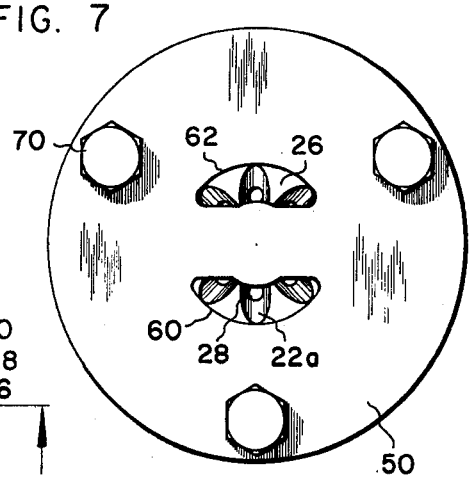
FIG. 7 is a plan view of the bottom of the pump.
Figure 8:
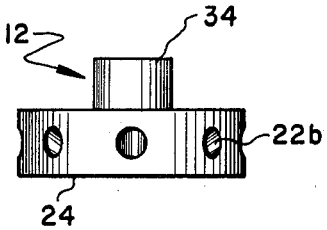
FIG. 8 is a side elevational view of the impeller of the pump.
Figure 5:
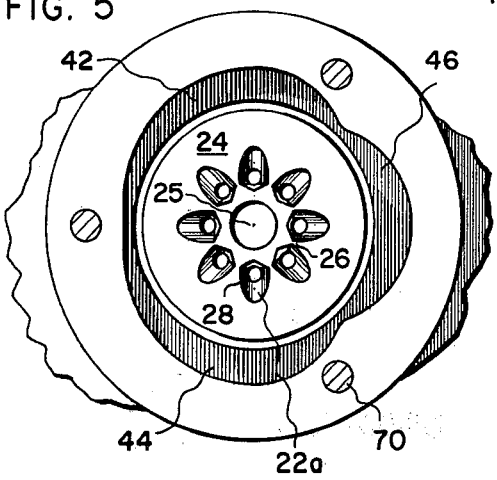
FIG. 5 is a horizontal cross-sectional view of the centrifugal oil pump shown in FIG. 4, taken on line 5—5 of the latter Figure.
Figure 9:
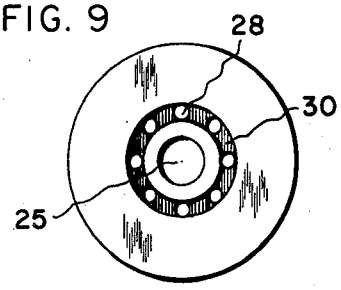
FIG. 9 is a top plan view of the impeller shown in FIG. 8.
Figure 6:
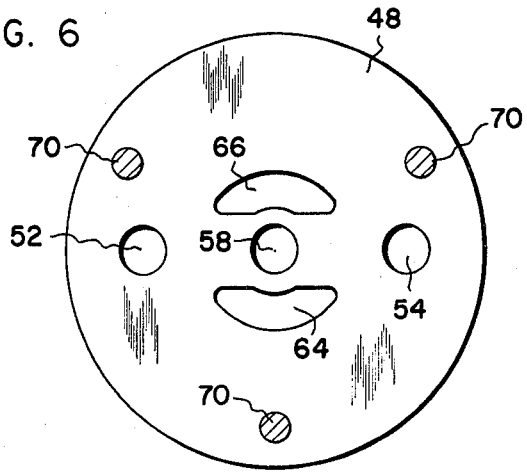
FIG. 6 is a cross-sectional view of the pump shown in FIG. 2, taken on line 6—6 of the latter Figure.

In the use and operation of a centrifugal oil pump embodying the present invention, end plate 50, seal 48, and housing 40 are held together securely by bolts 70, and oil in sump 16 can flow through oil entry openings 60 and 62 and openings 64 and 66 of the end plate and seal respectively. The end of the pump as exposed to the fluid in the sump is shown in FIG. 7. The oil thus reaches inlet openings 22*a* of tunnels 22 in impeller 20, and as the impeller turns during operation of the compressor the triangular-shaped, vane-like regions 26 between the tunnels aid in scooping the oil and imparting a rotational force thereto. The resultant centrifugal force propels the oil outwardly through tunnels 22 and into chambers 42, 44, and 46. From the chambers the oil flows through holes 52 and 54 of seal 48 into channel 56, and the oil flows along channel 56 toward the center thereof. The oil then passes through central opening 58 of the seal, through opening 25 in the impeller and rises in axial bore 18 to the compressor lubrication sites. Entrained gases rise in vent conduits 28 to the annular vent passage 30. From the vent passage the gases flow through vent outlet 32 to the inner free space of the compressor.

The drilled vane concept of the present invention substantially increases the head and flow performance of the present pump over comparable size pumps not having vanes, and equals or exceeds the performance of pumps employing previously used radial vane concepts. At slower operating speeds the present drilled vane oil pump will provide adequate lubrication to the lubricating sites most distant from the pump in a typical reciprocating compressor. Since the vanes are integral regions of the impeller which cannot become unattached, the danger of compressor damage resulting from loose vanes is eliminated, thus making the drilled vane concept preferable to previous vane concepts. The danger of damaging the compressor through improper installation resulting in reverse direction operation is eliminated in that the pump of the present invention works equally well for both directions of crankshaft rotation.

Although one embodiment of a centrifugal oil pump has been shown and described in detail herein, various changes may be made without departing from the scope of the present invention.

We claim:

1. A centrifugal fluid pump comprising a generally vertical shaft having a generally vertical bore therein for transferring fluid from a sump near the bottom of said shaft to a location thereabove; an impeller on the bottom of said shaft having a substantially planar bottom surface, a plurality of tunnels extending angularly upward and radially outward in said impeller, each of said tunnels having a discrete outlet opening at the periphery of said impeller and a discrete inlet opening in said bottom surface, said inlet openings being in spaced relation to each other and equidistant from a central opening in said impeller aligned with said bore, with regions of said impeller remaining between adjacent inlet openings being of generally triangular configuration along the plane of said bottom surface and functioning substantially as vanes in scooping oil from the sump and imparting a rotational movement thereto; a housing disposed around the periphery of said impeller and having a chamber for receiving fluid from said outlet openings; an end plate having a channel therein for receiving fluid from said chamber and for guiding said fluid to said central opening and said generally vertical bore; and a seal disposed between said end plate and said housing and impeller, said seal having openings for fluid to pass from said chamber to said channel and from said channel to said central opening of said impeller and said bore.

2. A centrifugal fluid pump as defined in claim 1 in which said tunnels are disposed at angles of about twenty degrees (20°) from the horizontal.

3. A centrifugal fluid pump as defined in claim 1 in which a vent conduit communicates with each of said tunnels near the innermost ends of said inlet openings thereof for directing entrained gases away from said tunnels.

4. A centrifugal fluid pump as defined in claim 3 in which each of said vent conduits communicates with an annular vent passage in said impeller; and a vent outlet extends from said annular passage to an external surface of said shaft.

5. A centrifugal fluid pump as defined in claim 3 in which said tunnels are disposed at angles of about twenty degrees (20°) from the horizontal.

6. A centrifugal fluid pump as defined in claim 5 in which an annular vent passage is disposed in said impeller above said vent conduits and in flow communication therewith; and a vent outlet extends from said annular passage to an external surface of said shaft.

7. A centrifugal pump impeller comprising a body having a generally cylindrical section for operating in a sump to capture and propel fluid outwardly from said body, said section having a substantially flat bottom surface with a plurality of discrete fluid scooping inlet openings therein, and an outlet opening disposed in the perimeter of said body for each of said inlet openings; and a tunnel extending angularly upward and radially outward from each of said inlet openings to an outlet opening, with the regions of said body remaining between adjacent tunnels having substantially triangular configurations along the plane of said substantially flat bottom surface, and functioning as vanes between said inlet openings.

8. A centrifugal pump impeller as defined in claim 7 in which said tunnels are disposed at angles of about twenty degrees (20°) from the horizontal.

9. A centrifugal pump impeller as definged in claim 7 in which a vent conduct extends upwardly in said impeller from each of said tunnels.

10. A centrifugal pump impeller as defined in claim 9 in which said vent conduits communicate with said tunnels near said inlet openings.

11. A centrifugal pump impeller as defined in claim 10 in which said tunnels are disposed at angles of about twenty degrees (20°) from the horizontal.

12. A centrifugal pump impeller as defined in claims 9, 10 or 11 in which an annular vent passage is disposed in said impeller, said vent conduits are in flow communication with said passage, and a vent outlet extends from said passage.

* * * * *